US005092388A

United States Patent [19]

Evers

[11] Patent Number: 5,092,388

[45] Date of Patent: Mar. 3, 1992

[54] ROLLABLE WINDOW SCREEN GUIDE LOCKING ASSEMBLY

[75] Inventor: Robert S. Evers, Pella, Iowa

[73] Assignee: Rolscreen Company, Pella, Iowa

[21] Appl. No.: 615,504

[22] Filed: Nov. 19, 1990

[51] Int. Cl.[5] ..... E06B 9/17

[52] U.S. Cl. ..... 160/269; 160/268.1; 160/26

[58] Field of Search ..... 160/269, 273.1, 268.1, 160/271, 31, 23.1, 26

[56] References Cited

U.S. PATENT DOCUMENTS

| | | | |
|---|---|---|---|
| 2,769,491 | 11/1956 | Pitcoff | 160/269 X |
| 2,886,103 | 5/1959 | Pitcoff | 160/269 |
| 4,531,562 | 7/1985 | Swanson | 160/290.1 X |
| 4,702,297 | 10/1987 | Van Klompenburg | 160/271 |

*Primary Examiner*—Blair M. Johnson

*Attorney, Agent, or Firm*—Zarley, McKee, Thomte, Voorhees & Sease

[57] ABSTRACT

A spring powered roll type fiberglass window screen has side edges received in guide channels in which locking bars are pivotally and slidably received. In closing the screen, the locking bars are longitudinally slidable by a screen actuator which in turn causes the locking bars to be pivoted into engagement with the screen by action of a guide actuator tab engaging a cam surface on the locking bar. In opening the screen, the screen actuator moves the locking bar upwardly until it is pivoted out of engagement therewith by a guide cam surface on the guide channel whereupon the screen is free to move to a fully raised position, leaving behind the locking bar.

24 Claims, 3 Drawing Sheets

ROLLABLE WINDOW SCREEN GUIDE LOCKING ASSEMBLY

BACKGROUND OF THE INVENTION

The Rolscreen Company, Pella Iowa, pioneered the roll up type screen. A more recent version of their window screen is disclosed in the Van Klompenburg patent 4,702,297, issued Oct. 27, 1987. A spring powered roll is provided in the header over the window and hand operated control levers are provided on opposite sides of the screen for engagement with vertical guide members to hold the screen in a desired position against the upward pull of the spring. In this type of roll screen staples are attached to the screen side edges to keep the screen from pulling out of the side guide channels. This is acceptable when the screen is made of metal.

The use of fiberglass screens which are very light, thin and flexible do not hold staples well and thus a different type of holding means is needed for the sides of a roll type fiberglass screen to seal it against insects and to keep it intact against wind pressure. A screen holding means should also overcome the upward pull of the spring on the screen. The screen holding means should also engage and disengage the side edges of the screen automatically as the screen is lowered and raised.

SUMMARY OF THE INVENTION

The side edges of the screen are received in a guide channel in which a locking bar is also slidably movable and pivotable between locked and unlocked positions. A tab in the bottom of a guide channel engages a cam surface on the locking bar to pivot the locking bar into engagement with the screen to secure the screen against movement and to make it insect tight. An actuator on each lower corner of the screen engages the locking bar to move it downwardly in turn causing the actuation tab to pivot the locking bar into locking engagement with the screen. Upward movement of the screen also moves the locking bar upwardly out of engagement with the actuation tab and cam tabs on the guide channel engages the locking bar to pivot it to its unlocked position. At this time, the locking bar is disengaged from the screen actuator allowing the screen to be freely and fully raised to an open position.

Thus, it is seen that the screen slides freely in the guide channel when being raised and lowered until the screen is close to being closed when the locking bar is pivoted into locking engagement with the screen side edges which then seals the screen at the side edges against insects and holds the screen in the down position against the upward pull of the roll up spring. Manual upward movement of the screen releases the side locking bars for free unimpeded movement of the screen to the rolled up, raised open position.

DESCRIPTION OF THE PREFERRED EMBODIMENT

Figure 1:
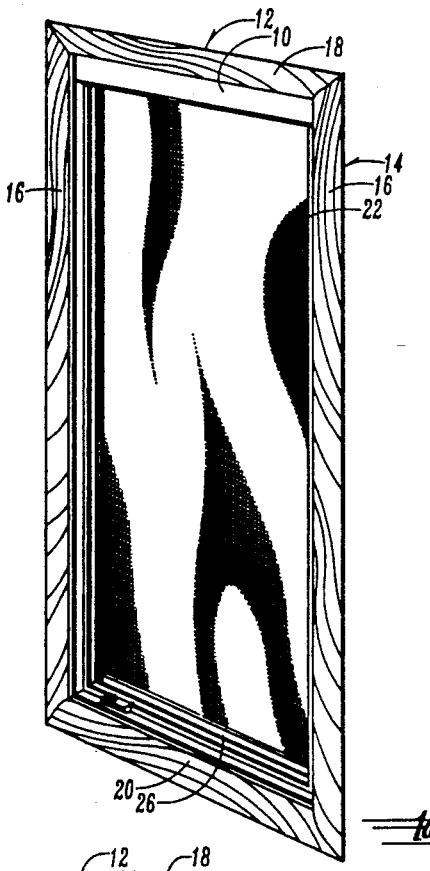
FIG. 1 is a perspective view of a window using the roll up screen of this invention.
Figure 2:
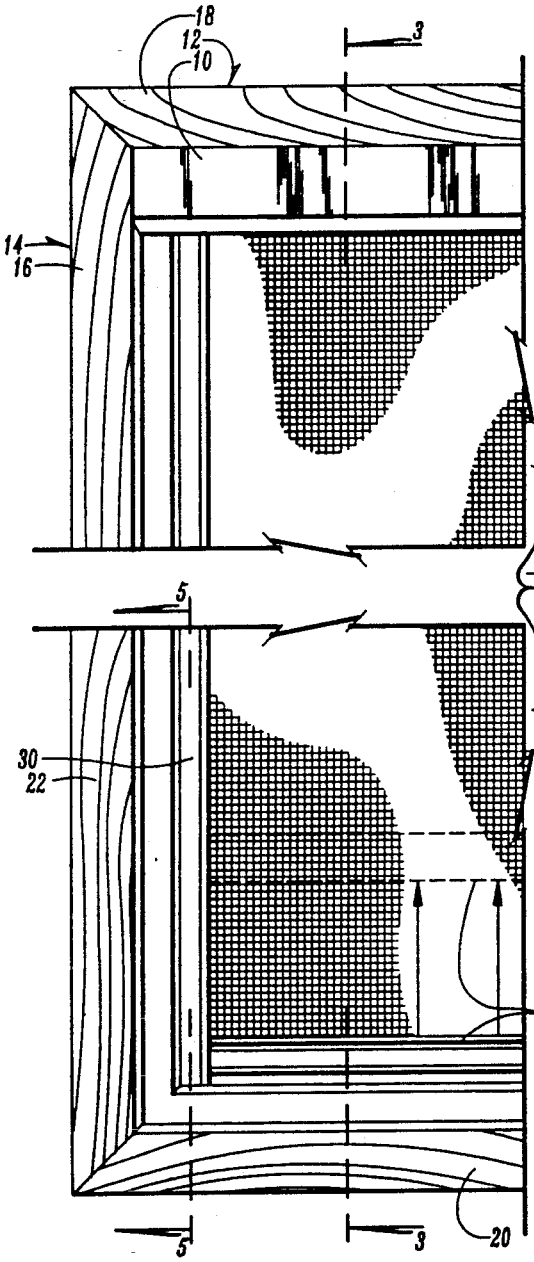
FIG. 2 is a fragmentary enlarged view of the roll screen window.

The rolling screen assembly of this invention is referred to generally in FIG. 2 by the reference numeral 10 and is shown in a window 12 in FIG. 1. The window 12 has a frame 14 including side jambs 16, a head 18, and a sill 20.

Figure 3:
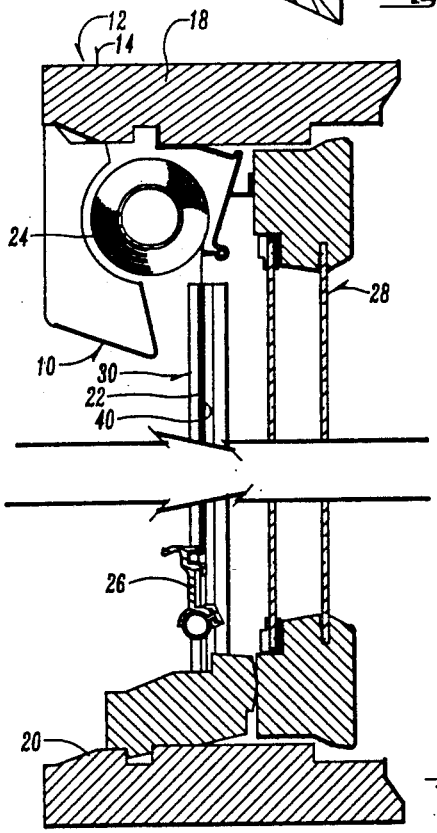
FIG. 3 is a cross sectional view taken along line 3—3 in FIG. 2.

A fiberglass screen 22 is stored on a roll 24 which is rotatable by a spring not shown. A pull bar 26 is positioned at the lower end of the screen 22. A dual pane window 28 is positioned next to the screen 22 in FIG. 3.

A guide channel 30 is recessed and extends vertically along each side of the window in the side jambs 16. A screen locking bar 32 is positioned in the guide channel 30 and is movable in response to a screen actuator 34 at each lower corner of the screen 22.

The guide channel 30 includes side walls 36 and 38 defining an elongated opening 40 in which the side edges 42 of the screen are received. An upstanding wall 44 on the wall 38 cooperates with a second upstanding wall 46 to form a channel slot 48 into which the side edge 42 of the screen 22 is pressed by the locking bar 32 as will be described later. The channel wall 36 includes on its inside face a groove 50 which receives a tongue 52 on the locking bar 32 thereby allowing the locking bar to pivot between locked and unlocked positions. The locking bar 32 further includes elongated upstanding spaced apart walls or lips 54 which straddle or register with the walls 44 and 46 of the guide channel 30, clamping the side edges 42 of the screen 22 therebetween.

Figure 9:
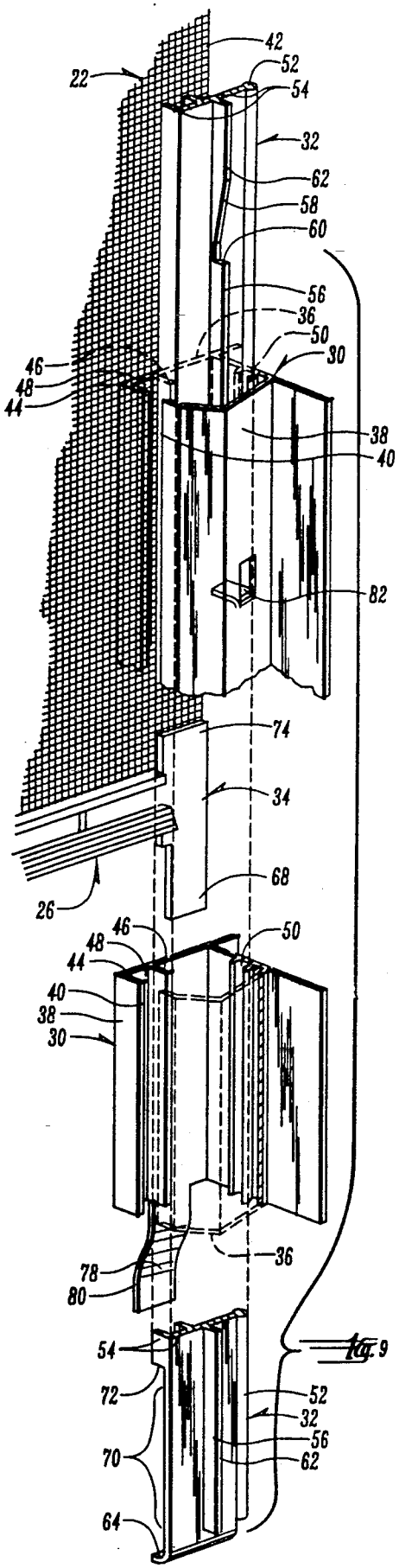
FIG. 9 is a fragmentary exploded perspective view of the screen assembly.

A longitudinally extending rib 56 is provided on the opposite side from the walls 54 and includes a series of spaced apart cam surfaces 58. The cam surface 58 includes a shoulder 60 at the lower end and a raised surface 62 at the other end, as seen in FIG. 9.

Figure 5:
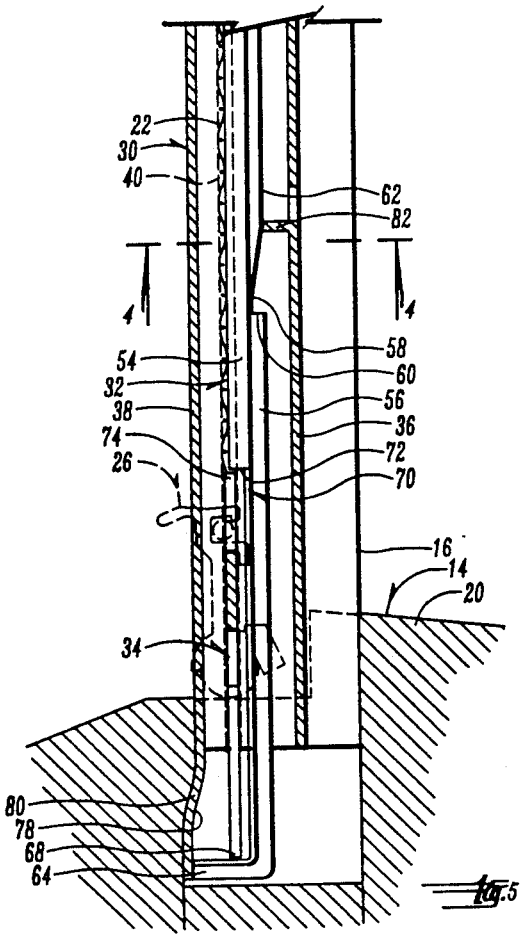
FIG. 5 is a cross sectional view taken along line 5—5 in FIG. 2 showing the locking bar cam surface in engagement with the guide channel actuation tab when the screen is in its lowered position.
Figure 7:
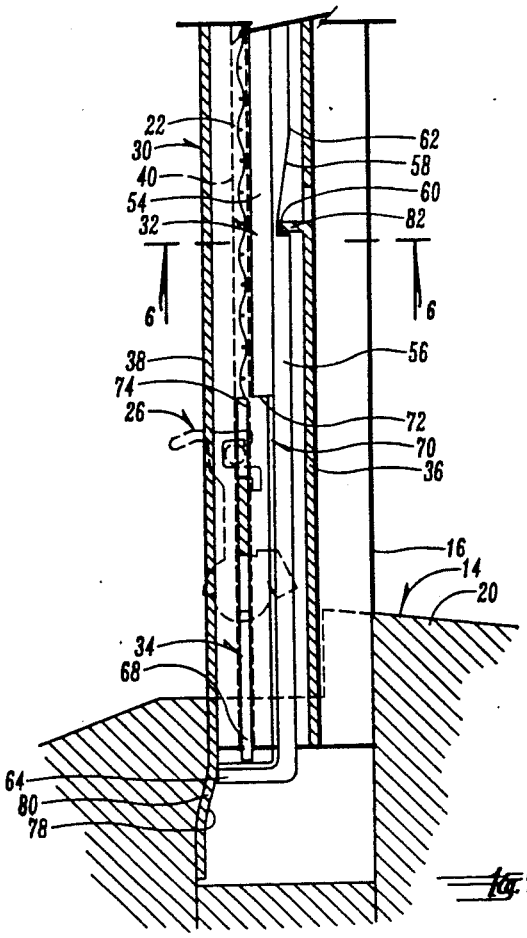
FIG. 7 is a cross sectional view similar to FIG. 5, but showing the locking bar in its unlocked position.
Figure 8:
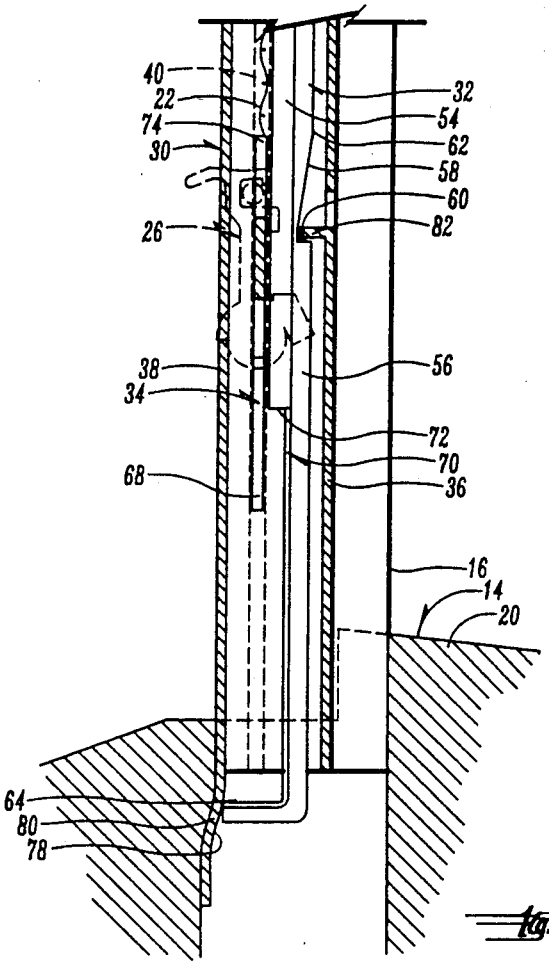
FIG. 8 is a fragmentary view similar to FIG. 7, but showing the screen in a partially raised position.

A laterally extending stop tab 64 is provided at the lower end of the locking bar 32 and is positioned in the line of travel of the screen actuator 34 such that the lower end 68 engages the tab 64 when the actuator is being moved downwardly as seen in FIG. 5. A stop notch 70 is formed at the lower end of the locking bar 32 in the outside wall 54 and includes an upper end shoulder 72 for engagement by the upper end 74 of the screen actuator 34 when the screen is being raised, as seen in FIG. 5. The notch 70 allows the locking bar 32 to clear the screen actuator 34 when the screen actuator 34 rotates into the locked position of FIG. 5. When the screen has been raised to the position of FIG. 7, the stop tab 64 has moved into engagement with a cam surface 78 on a cam tab 80 which rotates the locking bar 32 to an unlocked position which is now permitted by the fact that the actuation tab 82 is now at the lower end of the cam surface 58, as seen in FIG. 7. The outer side edge of the locking bar 32, as seen in FIG. 7, has now pivoted to the right, disengaging the shoulder 72 from the upper end 74 of the screen actuator 34, thereby allowing free travel of the screen upwardly. The guide tab 82 restricts further upward travel of the locking bar 32 by its engagement with the shoulder 60 at the lower end of the cam surface 58.

Figure 4:
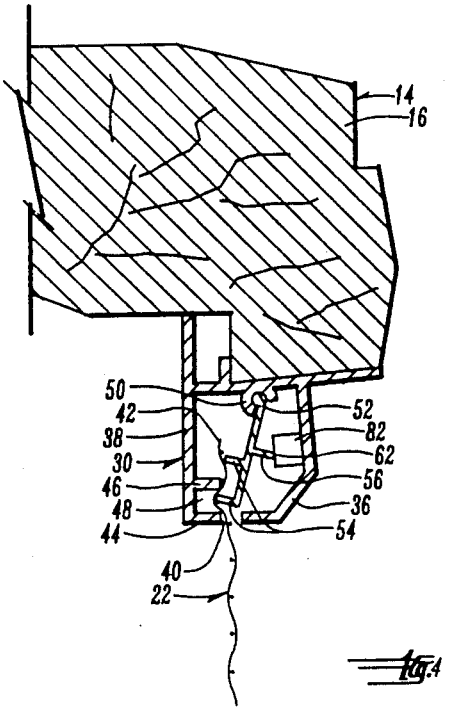
FIG. 4 is a cross sectional view taken along line 4—4 in FIG. 5 showing the locking bar in its locking position in engagement with the screen.
Figure 6:
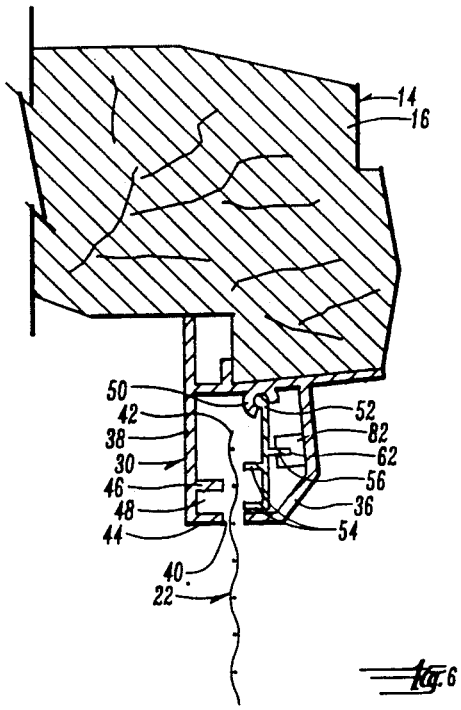
FIG. 6 is a view taken along line 6—6 in FIG. 7 showing the locking bar in its unlocked position disengaged from the sides of the screen.

Thus it is seen in operation that the locking bar 32 in FIG. 4 pivots to the left and squeezes the screen side edge 42 between the registering walls or lips 54 on the locking oar and the walls 44 and 46 on the guide channel 30. The screen actuator 34 initiates the clamping action when it is moved downwardly as it engages the stop tab 64 when the screen is almost closed, as seen in FIG. 7, thereby sliding the locking bar 32 downwardly to the position of FIG. 5, causing the guide actuation tab 82 to move along the cam surface 58 to the position in FIG. 5 where the locking bar is fully rotated into the clamping position shown. When it comes time to open the screen, upward pressure on the pull bar 26 causes the screen actuator 34 to engage the shoulder 72 of the notch 70 in the locking bar 32, thereby moving the locking bar upwardly to the position of FIG. 7, whereby they are disengaged as a result of the tab 64 engaging the cam tab 80 cam surface 78 and rotating the locking bar 32 away from engagement with the screen actuator 34. The guide actuation tab 82 is now in position to allow this counterpivotal movement, as seen in FIG. 7, and also now engages the shoulder 60, limiting further upward travel of the locking bar.

It is to be understood that a screen using the rolling screen assembly 10 could be oriented horizontally and would function in the same manner as described being positioned vertically.

I claim:

1. A rolling window screen assembly installed in a window frame, said frame including a sill, a head and side jambs, said assembly comprising, a screen mounted on said window frame adjacent said head and being rollable along said jambs of said window frame between raised and lowered positions, said screen having opposite side edges, an upper edge, a lower edge and opposite interior and exterior surfaces, a pair of elongated guide means mounted extending along each of said side jambs for guiding said opposite edges of said screen while said screen is unrolled along said jambs, locking bar means associated with said guide means for selectively engaging said screen side edge to limit movement of said screen and to provide a seal between said screen and said guide means, and said screen includes an actuator means which engages said locking bar means when said screen has been moved downwardly to said lowered position causing said locking bar means to engage said screen side edge as a result of said downward movement.

2. A rolling window screen assembly installed in a window frame, said frame including a sill, a head and side jambs, said assembly comprising, a screen mounted on said window frame adjacent said head and being rollable along said jambs of said window frame between raised and lowered positions, said screen having opposite side edges, an upper edge, a lower edge and opposite interior and exterior surfaces, a pair of elongated guide means mounted extending along each of said side jambs for guiding said opposite edges of said screen while said screen is unrolled along said jambs, locking bar means associated with said guide means for selectively engaging said screen side edge to limit movement of said screen and to provide a seal between said screen and said guide means, said screen including an actuator means which engages said locking bar means when said screen is being moved downwardly to said lowered position and continued downward movement of said actuator means causes said engagement of said locking bar means with said screen side edge.

3. A rolling window screen assembly installed in a window frame, said frame including a sill, a head and side jambs, said assembly comprising, a screen mounted on said window frame adjacent said head and being rollable along said jambs of said window frame between raised and lowered positions, said screen having opposite side edges, an upper edge, a lower edge and opposite interior and exterior surfaces, a pair of elongated guide means mounted extending along each of said side jambs for guiding said opposite edges of said screen while said screen is unrolled along said jambs, locking bar means associated with said guide means for selectively engaging said screen side edge to limit movement of said screen and to provide a seal between said screen and said guide means, said screen includes an actuator means which engages said locking bar means when said screen is being moved downwardly and only when said actuator means is adjacent said lowered position thereby causing engagement of said locking bar means with said screen side edge.

4. The structure of claim 3 wherein said engagement of said locking bar means with said screen is further defined by said guide means having an elongated groove means and said locking bar means having an elongated lip means and the screen side edge being positioned there between, and an actuation means associated with said guide means for moving said lip means against said screen side edge and pressing said screen side edge into said guide means groove.

5. The structure of claim 4 wherein movement of said lip means on said locking bar means against said screen is further defined by said actuation means engaging said locking bar means and rotating said locking bar means whereby said lip moves into engagement with the screen side edge.

6. The structure of claim 5 wherein said pivoting of said locking bar means by said actuation means is further defined by said locking bar means being longitudinally moveable in said guide means and engageable with said actuation means to cause said rotation of said locking bar means.

7. The structure of claim 6 wherein said guide means actuation means is located in the path of longitudinal travel of said locking bar means moving in one direction, and said locking bar means includes a cam means having a cam surface engageable by said guide means actuation means to gradually increase pressure by said lip means against said screen side edge.

8. The structure of claim 6 wherein said screen actuation means is adapted to operatively engage said locking bar means when said screen is being moved to said lowered position thereby longitudinally moving said locking bar means in said guide means for engagement by said guide means actuation means.

9. The structure of claim 8 wherein said screen actuation means is located at the lower side edge of said screen.

10. The structure of claim 9 wherein said locking bar includes upper and lower ends and a stop means is located on said lower end in the path of travel of said screen actuation means for engagement by said screen actuation means when said screen is being moved to said lowered position.

11. The structure of claim 10 wherein said guide means includes a cam means in the path of said locking bar means adapted to rotate said locking bar means lip out of engagement with said screen when said locking bar means is moved longitudinally in the opposite direction from movement in said one direction by said screen actuator means.

12. The structure of claim 11 wherein it is the locking bar means stop means that engages said guide means cam means.

13. The structure of claim 12 wherein said stop means is further defined as being a tab on said locking bar means extending laterally of said elongated guide means.

14. The structure of claim 13 wherein said guide means has upper and lower ends and said guide means cam means is further defined as being a tab which extends downwardly and laterally outwardly beyond the lower end of said guide means whereby when said locking bar tab means is moved upwardly, it engages said guide means cam tab causing said locking bar to rotate in the opposite direction from rotation caused by said guide means actuation means.

15. The structure of claim 5 wherein said locking bar means and said guide means have cooperating tongue and groove pivot means which allow said locking bar means to pivot and slide longitudinally of said guide means.

16. The structure of claim 15 wherein said locking bar means and said guide means each have opposite longitudinal sides, and said cooperating tongue and groove pivot means are located on longitudinal sides opposite said locking bar means lip means and said guide means elongated groove means.

17. The structure of claim 5 wherein said guide means groove is further defined by a pair of spaced apart longitudinally extending walls and locking bar lip means is further defined as being one of a pair of spaced apart lips which are in registry with said guide means groove.

18. The structure of claim 7 wherein said guide means actuation means is further defined by being a laterally extending tab and said locking bar cam means cam surface is further defined as being on a longitudinally extending rib on said locking bar which faces said guide means actuation means.

19. The structure of claim 18 wherein said guide means and locking bar means include a plurality of cooperating cam surfaces and actuation tabs spaced along the length of said guide means.

20. The structure of claim 10 wherein said locking bar means includes a stop means which is in the path of and engaged by said screen actuator means when said screen is moved upwardly from its lowered position and in turn moving said locking bar upwardly into engagement with a cam means on said guide means which causes said locking bar to rotate in the opposite direction from said pivoting caused by said guide means actuation means when said screen and locking bar means were being moved to said lowered position.

21. The structure of claim 20 wherein said guide means actuation means is gradually disengaged from said locking bar means as said screen and locking bar are moved upwardly from said lowered position which in turn allows said screen actuation means to be disengaged from said locking bar stop means thereby ending upward movement of said locking bar as said screen is moved further upwardly.

22. The structure of claim 21 wherein said locking bar stop means is further defined as a notch having upper and lower ends with said upper end having an end wall engageable by said screen actuation means.

23. The structure of claim 9 wherein said locking bar means includes a notch adapted to receive said screen actuation means thereby providing clearance when said locking bar means is rotated.

24. The structure of claim 22 wherein said notch in said locking bar means is further defined as being adapted to receive said screen actuation means to provide clearance when said locking bar means is rotated causing said lip to move into engagement with said screen side edge.

* * * * *